United States Patent [19]

Wheelwright et al.

[11] 4,067,253

[45] Jan. 10, 1978

[54] ELECTRONIC TONE-GENERATING SYSTEM

[75] Inventors: Robert W. Wheelwright, Town of Tonawanda; Peter E. Solender, Williamsville, both of N.Y.

[73] Assignee: The Wurlitzer Company, DeKalb, Ill.

[21] Appl. No.: 673,194

[22] Filed: Apr. 2, 1976

[51] Int. Cl.[2] ..... G10H 1/02; G10H 5/00

[52] U.S. Cl. ..... 84/1.1; 84/1.13; 84/1.24; 84/1.26; 84/1.27

[58] Field of Search ..... 84/1.01, 1.09, 1.1, 84/1.13, 1.17, 1.22, 1.24, 1.26, 1.27, DIG. 8

[56] References Cited

U.S. PATENT DOCUMENTS

| | | | |
|---|---|---|---|
| 3,821,714 | 6/1974 | Tomisawa et al. | 84/1.01 X |
| 3,823,390 | 7/1974 | Tomisawa et al. | 84/1.01 X |
| 3,882,751 | 5/1975 | Tomisawa et al. | 84/1.01 |
| 3,902,397 | 9/1975 | Morez et al. | 84/1.27 |
| 3,903,775 | 9/1975 | Kondo et al. | 84/1.01 |
| 3,908,504 | 9/1975 | Deutsch | 84/1.22 X |
| 4,018,125 | 4/1977 | Nishimoto | 84/1.27 X |

*Primary Examiner*—Stanley J. Witkowski
*Attorney, Agent, or Firm*—Olson, Trexler, Wolters, Bushnell & Fosse, Ltd.

[57] ABSTRACT

A tone-generating system for an electronic musical instrument of the percussion type is provided wherein an audible tone closely approximating the corresponding tone of a conventional instrument is generated electronically. A single-pole, double-throw switch is actuated by a key to initiate generation of the tone and a tri-level detecting circuit coupled to the switch is utilized to determine which of the three states the switch is in; that is, the two "throws" or positions of the switch which correspond to the released and depressed positions of the key, and the state in which the switch is between the other two positions. By detecting the three states and developing corresponding control signals, counting circuitry may be utilized to determine the intensity with which the key is depressed to enable generation by a read-only memory of digital scaling signals representative of the variations in amplitude of the initiated tone with respect to the intensity with which the key is depressed. An envelope control counter responds to the control signals and a variable rate clock to drive an envelope generating read-only memory to generate a digital envelope signal. A master frequency generator comprising an oscillator and divider circuitry is used to generate a digital pulse train representative of the frequency spectrum of the initiated tone. The digital scaling signal and digital envelope signal are combined in a multiplying digital-to-analog converter to obtain a corresponding composite signal. The composite signal is integrated to improve its analog characteristics and then it is applied to an output gate wherein it modulates the oscillating signal to produce an electrical signal representative of the initiated tone. The composite signal may be filtered and amplified by appropriate circuitry and then audibly reproduced by a loudspeaker. In the multiple-tone embodiments of the invention, multiplexers are utilized to reduce the amount of circuitry duplication and interconnecting wiring.

33 Claims, 5 Drawing Figures

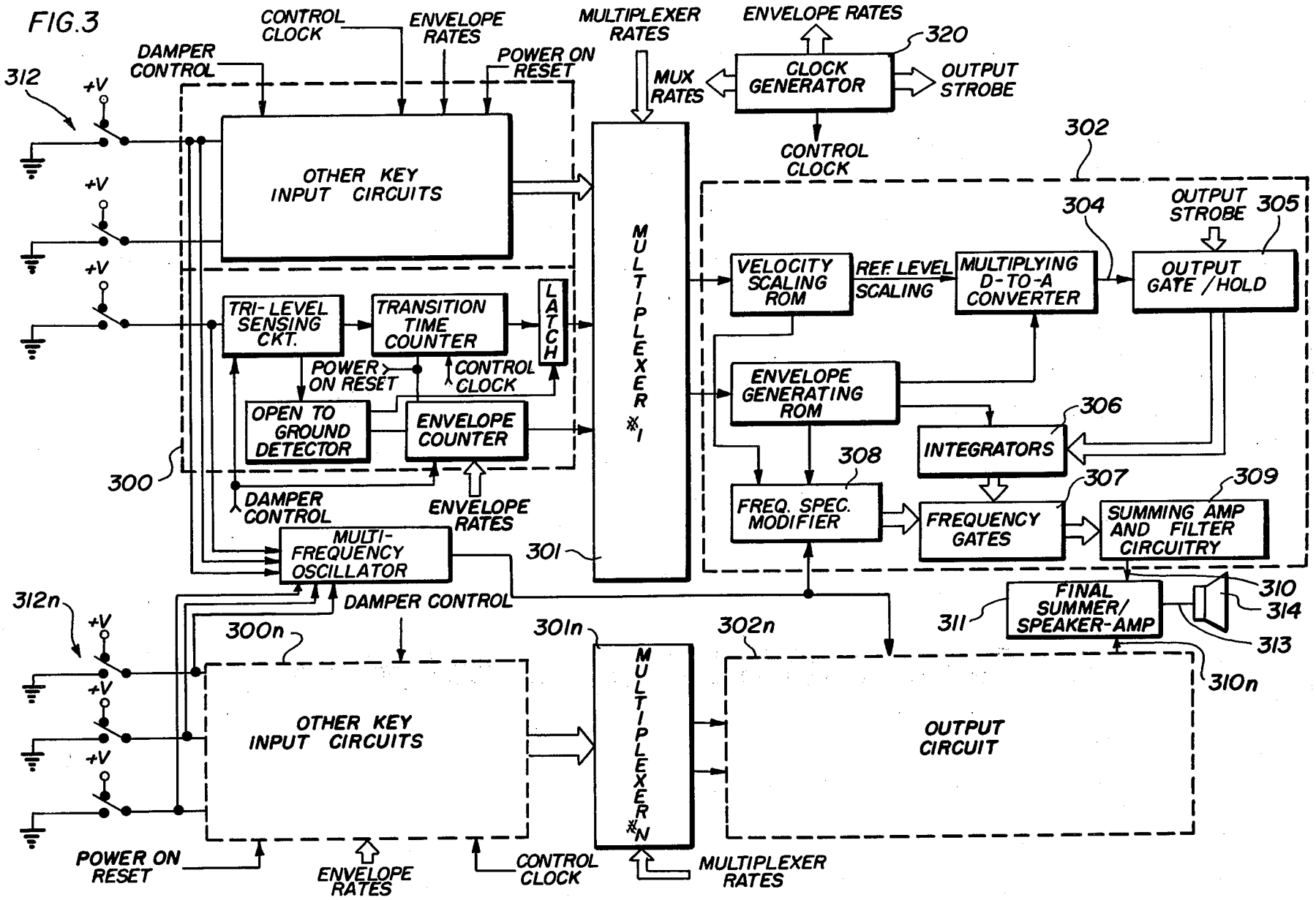
OUTPUT STROBE
305
OUTPUT GATE /HOLD
309
SUMMING AMP AND FILTER CIRCUITRY
310
314
313
310n
302
304
MULTIPLYING D-TO-A CONVERTER
306
INTEGRATORS
307
FREQUENCY GATES
FINAL SUMMER/ SPEAKER-AMP
311
OUTPUT CIRCUIT
OUTPUT STROBE
320
ENVELOPE RATES
CLOCK GENERATOR
CONTROL CLOCK
REF. LEVEL
SCALING
VELOCITY SCALING ROM
ENVELOPE GENERATING ROM
308
FREQ. SPEC. MODIFIER
302n
MULTIPLEXER RATES
MUX RATES
MULTIPLEXER #1
MULTIPLEXER #N
301
301n
POWER ON RESET
ENVELOPE RATES
CONTROL CLOCK
OTHER KEY INPUT CIRCUITS
LATCH
TRANSITION TIME COUNTER
CONTROL CLOCK
ENVELOPE COUNTER
ENVELOPE RATES
MULTI-FREQUENCY OSCILLATOR
DAMPER CONTROL
TRI-LEVEL SENSING CKT.
POWER ON RESET
OPEN TO GROUND DETECTOR
DAMPER CONTROL
300n
300
+V
312
312n
FIG. 3

ELECTRONIC TONE-GENERATING SYSTEM

BACKGROUND OF THE INVENTION

This invention relates generally to an electronic tone-generating system for a musical instrument which simulates the tones of a conventional, non-electronic instrument and, more particularly, to such a system which is especially adapted for use in an electronic piano.

Efforts have been made heretofore to develop electronic tone-generating systems for simulating the overall tonal quality and response characteristics of conventional musical instruments, especially percussion instruments. Because of the time-varying harmonic structure and complex envelope characteristic of a percussive tone, it has been difficult or impossible, either from a technical or a financial standpoint, to generate electronically the requisite composite signal to simulate true percussive tones.

For example, each of the notes or tones of a conventional piano with stretched wires percussively actuated by a hammer (hereinafter generally referred to as "true" piano tones) inherently possesses a tonal envelope which initially reaches a maximum magnitude or intensity rather quickly and which thereafter decays at a predetermined or inherent rate until vibration stops, either naturally after an extended time period or upon release of the key which causes a damper to engage and stop the vibrating piano wire. Moreover, the initial striking of the wire stretches it which causes its resonant frequency to be slightly lower than its unstretched resonant frequency. Various studies have shown that for these and other reasons the character of a true piano tone is dependent upon the combination of over 30 inharmonic partial frequencies, and that this partial frequency structure is continually changing during the decay period of the tone in an almost random manner.

Conventional electronic tone-generating systems for simulating the tones of a piano typically generate the different tones by combining two separate signals. The first is a uniform-amplitude oscillatory signal having a fundamental frequency approximately that of the true piano tone plus some of the harmonics thereof. The second signal is typically referred to as an envelope signal and it represents the intensity with which the piano key is struck and the duration or length of time that the key is depressed. Thus, for realistically simulating a piano tone, each of these two electronically-generated signals must be relatively complex and, consequently, the electronic generation thereof has presented significant problems.

OBJECTS AND SUMMARY OF THE INVENTION

The principal object of the present invention is to provide a new and improved electronic tone-generating system for a musical instrument of the percussion type.

It is a further object of the invention to provide such a system in which the electronically-generated tone has a predetermined frequency spectrum and an envelope characteristic which varies in accordance with the intensity of the manual action by which the player of the instrument selects the tone.

It is yet another object of the invention to provide such a system which more closely approximates the tones produced by a conventional piano by utilizing digital techniques to obtain the exact signal relationships desired, minimize component tolerance problems in the main production of the system, and capable of being constructed with LSI (large-scale integration) circuitry to minimize the cost of the system.

In order to effect the foregoing objects, a tone-generating system for an electronic musical instrument of the percussion type is provided wherein an audible tone closely approximating the corresponding tone of a conventional instrument is generated electronically in response to the manual actuation of the system by the player of the instrument. The initiated tone has a predetermined frequency spectrum and an envelope characteristic which varies in accordance with the intensity of the manual actuation by which the player of the instrument actuates the tone. Manually actuable means are provided for initiating generation of the tone and detector means are coupled to the tone initiating means, and are responsive to the actuation of the tone initiating means, for developing a control signal indicative of the intensity with which the tone initiating means is manually actuated. Means are coupled to the detector means and are responsive to the control signal for generating a digital scaling signal representative of the variations in amplitude of the initiated tone with respect to the intensity with which the tone initiating means is actuated. Oscillator means are coupled to the tone initiating means and are responsive to the actuation of the tone initiating means for generating an oscillatory electrical signal having the predetermined frequency spectrum of the initiated tone. A clock generator for generating a timing signal and memory means responsive to the timing signal are provided to generate a digital envelope signal. A multiplying digital-to-analog convertor combines the digital scaling signal with the digital envelope signal to form a corresponding composite analog signal. Output gate means are utilized to modulate the oscillating signal with the composite analog signal to obtain an electrical signal representative of the initiated tone. An electromechanical transducer is coupled to the output gate means and is responsive to the electrical signal for converting the signal into an audible tone.

BRIEF DESCRIPTION OF THE DRAWINGS

The features of the present invention which are believed to be novel are set forth with particularity in the appended claims. The invention, together with further objects and advantage thereof, may best be understood by reference to the following description taken in connection with the accompanying drawings, in the several figures of which like reference numerals identify like elements, and in which:

FIG. 3 is a block diagram of a multiple-tone embodiment of the invention in which certain tones are grouped in accordance with their frequency characteristics;

DESCRIPTION OF THE PREFERRED EMBODIMENT

Figure 1:
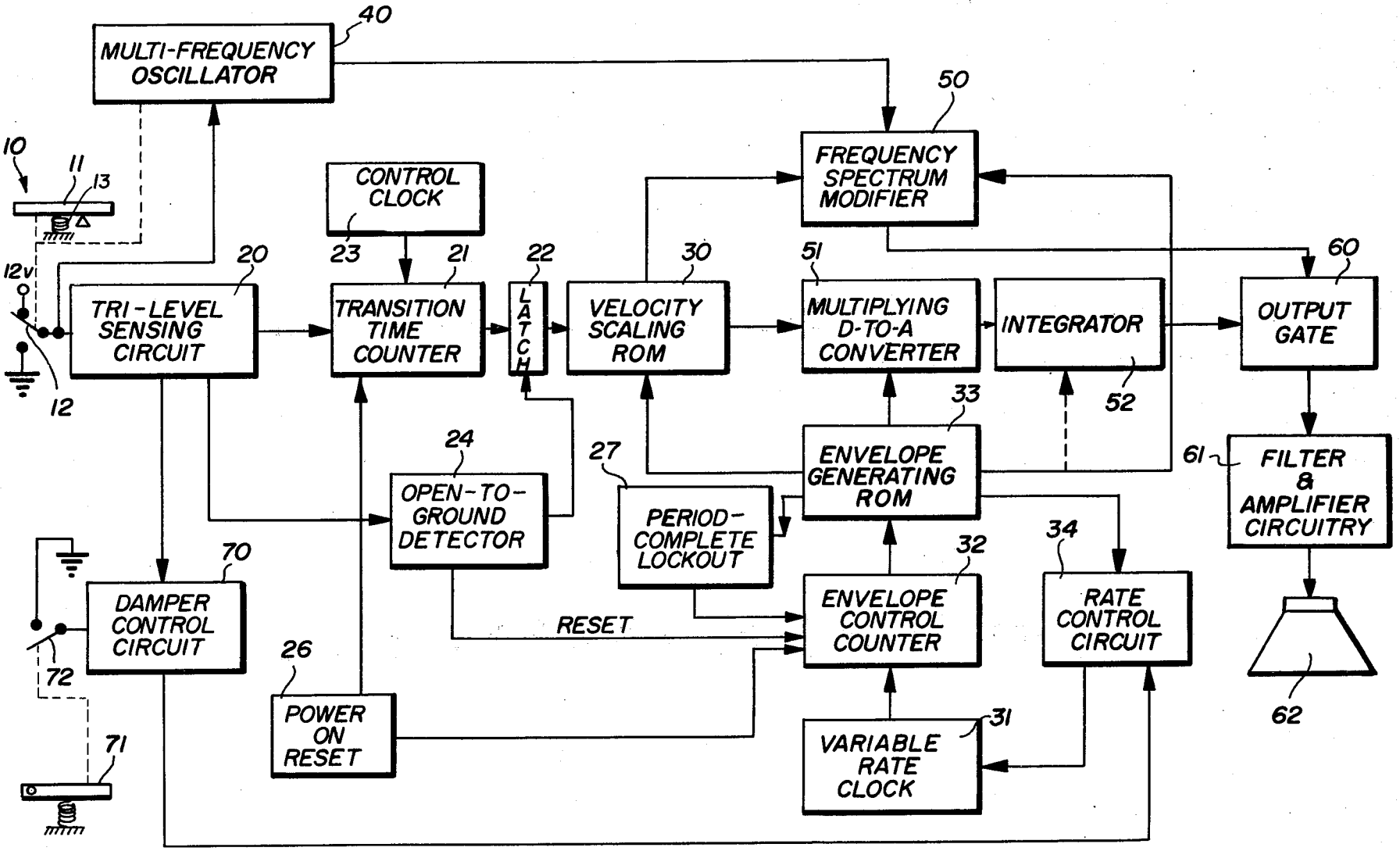
FIG. 1 is a block diagram of the electronic circuitry of a preferred embodiment of the invention.

With reference to FIG. 1, a preferred embodiment of a tone-generating system for an electronic musical instrument of the percussion type constructed in accordance with the present invention is shown wherein an audible tone closely approximating the corresponding tone of a conventional instrument is generated electronically in response to the manual actuation of the system by the player of the instrument. A typical application for the invention is that of an electronic piano; that is, an instrument in which all or a major portion of the notes or tones of a conventional hammer-and-wire piano are generated by means of electronic circuitry with no moving parts other than the keys of the keyboard and a corresponding plurality of electrical switches, for example, respectively associated with the individual keys of the keyboard. Although the invention is described in an electronic piano environment, it is to be understood that the principles of the invention may be utilized in other percussion type musical instruments in which the audible tones are generated electronically. Moreover, the present invention is discussed both with respect to a single tone embodiment and a multiple-tone embodiment, the latter not being discussed in as great detail as the former to avoid unnecessary repetition.

In general, the system of the embodiment of the invention illustrated in FIG. 1 comprises manually actuable tone-initiating means in the form of a keying transducer 10 which includes a key 11 and an associated SPDT switch 12 for initiating generation of the desired tone. Only one keying transducer is illustrated but it is understood that as many transducers as desired may be employed without departing from the principles of the present invention. Moreover, other embodiments of the invention may be constructed with alternative keying transducers utilizing electromagnetic or piezoelectric principles.

Detector means are provided generally in the form of a tri-level sensing circuit 20, transition time counter 21, latch 22, open-to-ground detector 24 which are coupled to switch 11 and are responsive to the actuation of keying transducer 10 for developing a control signal indicative of the intensity with which the keying transducer 10 is manually actuated. Means are provided in the form of a velocity scaling read-only memory 30 which is responsive to the control signal developed by the detector circuitry for generating a digital scaling signal representative of the initiated tone with respect to the intensity with which the tone initiating means is actuated.

The embodiment of the invention illustrated in FIG. 1 also includes oscillator means comprising a multi-frequency oscillator 40 coupled to switch 11 and responsive to the actuation of keying transducer 10 for generating an oscillatory signal having the desired fundamental frequencies for the tone initiated. Coupled to oscillator 40 is a spectrum modifier 50 for varying the harmonic content of the oscillatory signal in accordance with the tone initiated as weldl as the intensity with which it is initiated (i.e., how hard the key is struck). A variable rate clock 31 generates a timing signal, and means in the form of an envelope control counter 32 and envelope generating ROM (read-only memory) 33 are coupled to variable rate clock 31 and are responsive to the resultant timing signal and period complete lockout circuit 27 for generating a digital envelope signal. Converter means including a multiplying D-to-A (digital-to-analog) converter 51 and an integrating circuit 52 are coupled to velocity scaling ROM 30 and envelope generating ROM 33 for combining the digital scaling signal with the digital envelope signal to obtain a corresponding composite analog signal. Output means comprising an output gate 60 is coupled to multi-frequency oscillator 40 by means of frequency spectrum modifier 50. Gate 60 is also coupled to converter 51 by means of integrator 52 for modulating the oscillatory signal with the composite analog signal to produce an electrical signal representative of the initiated tone. This electrical signal may then be applied to suitable filtering and amplifying circuitry 61 to further shape the signal and increase its amplitude to a level adequate for reproduction by an electromechanical transducer such as a loudspeaker 62.

More specifically, the embodiment of the invention illustrated in FIG. 1 utilizes a keying transducer 10 having a key 11 which may be of any conventional design suitable to actuate switch 12. In some embodiments of the invention it may be preferable to have the key simulate the feel of a conventional piano key when it is actuated or struck while playing the instrument. Key assemblies utilizing magnetic or camming actions, for example, may be used to simulate the inertial effect of the key-hammer movement of a conventional piano. Moreover, alternative keying transducers may be employed which use electromagnetic or piezoelectric principles to initiate electronic generation of the desired tone.

Switch 12 is normally biased to the released or normal position, as illustrated in FIG. 1, either directly by a spring means (not shown) connected to switch 12 or indirectly by a spring means 13 connected to key 11. The "normal", "rest" or "released" position contact of switch 12 is connected to a 12-volt DC voltage source. although any source suitable for the particular detector circuitry used may be employed. The other terminal of switch 12, which is contacted when key 11 is depressed, is connected to ground in the illustrated embodiment of the invention but of course any other voltage source suitable for the detector circuitry may be used. Switch 12 is thus capable of developing a keying signal at its movable contactor or "pole" which has a first value (12 volts) when it is in the released state, a second value (0 volts) when it is in the depressed state, and a third value (an open-circuit voltage between 0 and 12 volts, depending upon the input circuitry of the tri-level sensing circuit 20) when it is between the two positions.

Keying transducer 10 is also effectively coupled to a multiple-frequency oscillator 40 to cause it to generate an oscillatory signal having the desired frequency spectrum for the tone initiated by the depression of key 11. Although any suitable multiple-frequency oscillator circuit may be used without departing from the principles of the invention, one employing an oscillator operating at an ultrasonic frequency (e.g., 1.26 megahertz) which is divided into audiofrequency signals that are then gated together to produce either a one-fourth or one-eighth duty cycle pulse-train output signal has been found to generate a frequency spectrum which is particularly adaptable for simulating the frequency spectrum of a true piano tone.

A frequency spectrum modifier 50 is coupled to the output of oscillator 40 for varying the harmonic content of the oscillator signal. When the oscillator signal is in a rectangular-wave form, for example, spectrum modifier 50 may take the form of a read-only memory which is responsive to coded signals from velocity scaling read-only memory 30 and envelope generating read-only memory 30 to vary the duty cycle of the rectangular wave. Spectrum modifier 50 may of course be implemented in various ways depending upon the particular application involved.

Tri-level sensing circuit 20 is coupled to switch 12 and is responsive to the keying signal developed by switch 12 to sense which state switch 12 is in and develop a corresponding counter control signal which controls the actuation of transition time counter 21 and envelope control counter 32. Tri-level sensing circuit 20 may be include any circuitry suitable to detect the three levels of the keying signal developed by switch 12 and develop a corresponding counter control signal. One circuit especially well suited for trilevel sensing circuit 20 comprises a pair of complementary transistors (e.g., one NPN and one PNP transistor), coupled to the pole of switch 12. The transistors are biased such that when the pole of switch 12 is in the released position, one transistor is in the "on" or conductive state and the other is in the "off" or non-conductive state. By using complementary transistors with one turned on and the other turned off, the outputs at their respective collectors are equivalent; that is, each output may be "low" to represent a logical "0". Thus, with switch 12 in the released position, circuit 20 develops a binary-coded control signal having a logical code of "0 0". As the pole of switch 12 is moved from the released position to the depressed position, the transistor which was off remains off but the transistor which was on turns off, thus producing outputs at the respective collectors which are opposite (i.e., one is "high" and the other is "low"). Circuit 20 thus develops a control signal having the binary code of "0 1" (or "1 0"). When the pole of switch 12 reaches the other contact (i.e., the depressed position for key 10), the transistor which was off in the first two switch states turns on and the other one turns off. Again, since the transistors are complementary, their outputs are equivalent but now are both "high", yielding a counter control signal having the binary code of "1 1". Thus, tri-level sensing circuit 20 senses which state switch 12 is in and develops a corresponding counter control signal; that is, the logical "0 0" represents the switch being in the released position, logical "1 1" represents the switch being in the depressed position, and logical "0 1" (or "1 0") represents the switch being in transmit between the released and depressed positions.

As long as the tri-level sensing signal remains at logical "0 0", both transition time counter 21 and envelope control counter 32 remain in their reset states; that is, although they are being driven by their respective clock signals they are held at the zero count by the reset signal from the open-to-ground detector 24 which is driven by sensing circuit 20. When the system is initially energized, a power on reset circuit 26 resets both the transistion time and the the envelope counters. As soon as the tri-level sensing circuit senses the key state as logical "0 1", however, transition counter 21 is enabled and begins counting the elapsed time that a logical "0 1" condition exists but envelope control counter 32 continues to be held to its reset state. When the tri-level sensing circuit senses a logical "1 1" (i.e., key 11 is fully depressed), transition time counter 21 is stopped and envelope control counter 32 is enabled via the removal of the reset signal from the open-to-ground detector 24. The count made by transition time counter 21 is stored by latch 22 via a signal generated by the open-to-ground detector 24. This stored count is proportional to the time that elapsed when key 11 was moved from the reset position to the depressed position and is used to actuate amplitude scaling means comprising velocity scaling read-only memory 30. The actual signal stored is a digital code whose value is inversely proportional to the average velocity of key 11. Conventional buffer circuitry may be used for each counter as desired.

Transition time counter 21 may comprise any conventional counter driven by a clock 23 having a rate suitable for this purpose. One type of counter which has been found especially suitable for this application is a TTL (transistor-transistor logic) integrated circuit binary divide-by-16 counter which is commonly referred to by the identification number "7493". Equivalent MOS LSI (metal-oxide semiconductor, large-scale integration) circuitry may of course be employed where desired. The 7493 IC is actually two counters, a divide-by-two counter and a divide-by-8 counter in a single package which may be used together as a divide-by-16 counter or separately. Both counters ripple-count in the binary-up direction. To store the count corresponding to the transition time, a latch circuit 22 may be employed in the form of a TTL integrated circuit buffer storage register which is commonly referred to by the identification number "8200". Again, equivalent MOS LSI circuitry may be used instead of TTL.

The count stored in latch 22 is applied to velocity scaling read-only memory which has a predetermined plurality of digital amplitude scaling characteristics stored therein. There is a binary coded word (set of binary bits) for each possible velocity count from latch circuit 22. The binary coded word output of velocity scaling read-only memory 30 is applied to multiplying digital-to-analog converter 51, as hereinafter discussed in greater detail.

Envelope control counter 32 may comprise any counter suitable for this application, although a binary six-bit, divide-by-64 counter comprising two TTL integrated circuit devices (a number "7493" binary divide-by-16 counter and a number "7473" dual JK flip-flop) has been found to be particularly suitable for this purpose. The six-bit, divide-by-64 counter produces time sequential steps to read out incrementally the digitized representation stored in envelope generating ROM 33 at a controlled rate to generate a digital envelope signal. As in the case of transition time counter 21, equivalent MOS LSI circuitry may be substituted for the TTL circuitry.

In accordance with one feature of the invention, means including a variable rate clock circuit 31 controlled by an external control signal from a rate control circuit 34 are coupled to tri-level sensing circuit 20 (by means of a damper control circuit 70 which is discussed hereinafter in greater detail), envelope generating ROM 33, and envelope control counter 32 for varying the output rate of variable rate clock circuit 31, to thereby vary the rate of generation of the digital envelope signal by envelope generating ROM 33. This variation in the generation rate may be utilized to provide, for example, increased resolution during the initial portion of the tonal envelope. This variable rate of generation feature of the invention may also be employed to simulate the effect of a sustained tone.

Although the variable rate feature is not essential to the invention, it is desirable in some applications because it permits more flexibility in the type of tones generated. For example, an undamped or sustained true piano tone lasts approximately two to three seconds at the treble end of the spectrum and in excess of 25 seconds at the bass end. Moreover, a true piano tone is skewed such that its amplitude increases at a relatively fast rate during the first few tenths of a second and decreases at a much slower rate during the remaining time.

In general, a sustained or undamped tone is played on a conventional piano by holding the piano key depressed. Upon release of the key, a damper engages the vibrating piano wire to bring it to rest almost immediately. In addition, it is sometimes desirable for the player of the piano to override the key with a separate damper control, which causes the amplitude of the tone to decrease or decay quite slowly. For this purpose, a damper control circuit 70 may be coupled between sensing circuit 20 and rate control circuit 34. A damper pedal 71 may be coupled to a switch 72 which, upon actuation of damper pedal 71, causes damper circuit 70 to produce a damper control signal which is applied to variable rate clock 31 by means of rate control circuit 34 to make the desired rate change in the control clock signal applied to envelope control counter driving envelope generating ROM 33. Accordingly, rate control circuit 34 is utilized in the embodiment of the invention illustrated in FIG. 1 to automatically vary the counting rate of envelope control counter 32 from a relatively fast counting rate for the first few tenths of a second after the tone is initiated to either a slightly slower counting rate thereafter, for a damped tone, or a much slower rate for a sustained tone.

As referred to hereinabove, when the key of a conventional piano is released, a damper mechanism causes a felt pad or the like to engage the vibrating piano wire to stop the vibration much more quickly than if the key were held in the depressed position and the wire were allowed to cease vibrating naturally. To simulate this damping action electronically, an additional input signal to damper control circuit 70 from tri-level sensing circuit 20 indicates when key 11 is released (i.e., switch 12 is returned to its normal or rest position and the binary-coded control signal changes from "0 1" to "0 0") which thereby causes rate control circuit 34 to adjust the rate of variable rate clock 31 to make counter 32 count at a slightly faster speed than the initial rate, which results in the amplitude of the electronically-generated tone diminishing relatively rapidly. As long as key 11 remains depressed, however, damper control circuit 70 causes rate control circuit 34 to set the rate of clock 31 at a relatively slow rate, thereby causing the amplitude of the electronically-generated tone to diminish much more slowly.

By making envelope generating read-only memory 33 a 64-by-6 bit matrix (i.e., 6 input lines, six output lines, and 64 time periods), the digital envelope waveform for the initiated tone may be comprised of 64 time periods each containing amplitude-wise 6 bits of digital information. The first 32 time periods may be used to generate a digitized representation of the first few tenths of a second of the tone and the remaining 32 time periods may be used to generate a digitized representation of the remainder of the tone. Accordingly, when envelope control counter 32 begins counting, it causes envelope generating read-only memory 33 to output the first of its 6 amplitude bits of information. This first time period may be used not only to simulate the first 1/64 of the initiated tone but also to set variable rate clock 31 to the initial or "fast" rate. In addition, the 33rd time period may be used to actuate rate control circuit 34 to decrease the rate of variable rate clock 31 slightly when the damper circuit 70 is actuated, or to decrease the rate of variable rate clock 31 substantially when damper control circuit 70 is not actuated. When the 64th time period has occurred, period complete lockout circuit 27 will restore the reset to the envelope control counter 32.

The output signals of velocity scaling read-only memory 30 and envelope generating read-only memory 33 are combined in multiplying digital-to-analog converter 51 such that the converter output is the result of the envelope generating data scaled to reflect the velocity scaling data. One possible type of multiplying digital-to-analog converter operates such that the envelope data controls the particular fraction of reference voltage from the converter while the velocity scaling data controls the actual reference voltage setting. This basic converter is set up so that there are the same number of fractions of reference voltage as there are unique states in the output of the envelope generating ROM. Likewise the number of different reference voltages is the same as the number of unique states from the velocity scaling ROM.

An integrating circuit 52 smoothes the analog signal by converting it from a step-wise representation of the signal to a piece-wise approximation of the signal. As shown in FIG. 1 in dashed-line form, integrator 52 may be made responsive to envelope generating read-only memory 33 for changing the integration constant as the amplitude of the tone builds up and decays. Integrating circuit 52 is not essential to the present invention of course but this feature may be employed in embodiments of the invention where it is desired to have a tonal envelope smoother than that customarily produced by digital-to-analog converter 51.

Figure 2:
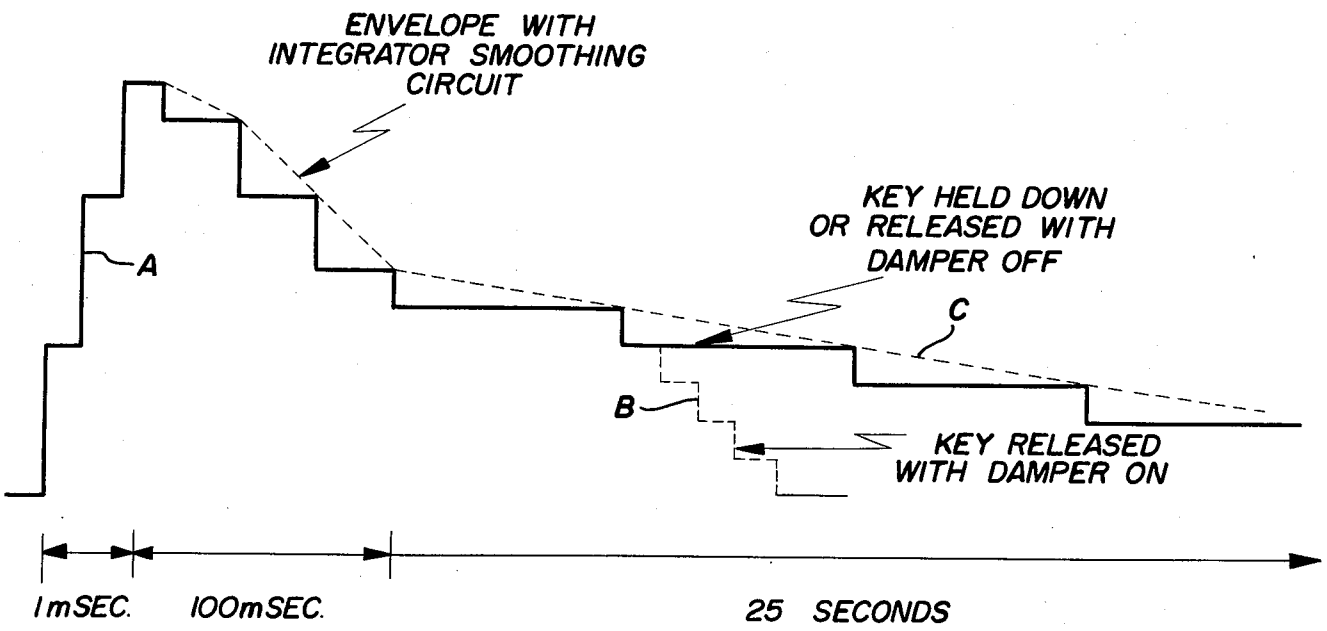
FIG. 2 is a graphical representation of a typical composite signal generated by the embodiment of the invention illustrated in FIG. 1.

FIG. 2 illustrates in general the overall envelope of a tone electronically generated by the embodiment of the invention illustrated in FIG. 1. The solid-line curve represents the step-wise, digital representation of the composite signal generated by the system without utilizing integrating circuit 52 whereas the dotted-line curve illustrates the smoother piece-wise approximation of the signal obtained with integrating circuit 52. FIG. 2 also illustrates the various portions of the tonal envelope as modified by the different counting rates of envelope control counter 32. The initial portion A, from 0 to a few tenths of a second, is generated by the "fast" rate. The next portion in time is either a slower or "compression" rate B, with the damper circuit inoperative, or a much longer rate C, which represents a sustained tone when the damper circuit is actuated.

The analog output signal of digital-to-analog converter 51, or integrating circuit 52 when it is utilized, is applied to output gate 60 wherein it modulates the oscillatory signal from multi-frequency oscillator 40, as modified by spectrum modifier 50, to produce an electrical signal representative of the tone initiated by keying transducer 10. Suitable filtering and amplifying circuitry 61 may be used to further refine the tonal envelope and increase its amplitude to a level suitable for conversion into a corresponding audible tone by an electromechanical transducer in the form of loudspeaker 62.

FIG. 3 shows a block diagram of a multiple-key embodiment of the invention. The system illustrated in FIG. 3 includes a group of switches 312, each of which is similar to switch 12 of the embodiment of the invention shown in FIG. 1. The outputs of switches 312 are processed through input circuit 300, multiplexer 301, and output circuit 302. For each switch 12, input circuit 300 includes a tri-level sensing circuit, transition-time counter latch, open-to-ground detector, and envelope counter similar to the embodiment of the invention shown in FIG. 1. Output circuit 302 contains circuitry similar to that of FIG. 1 (i.e., velocity scaling ROM, multiplying D-to-A converter, output gate/hold, envelope generating ROM, integrator, frequency spectrum modifier, frequency gates, summing amplifier and filter circuitry). The filtering preferably is used because, in a keyboard instrument such as a piano, different groups of tones of the keyboard sound more properly when fed through particular filters. Any number of groups of tones may be generated, of course, and as shown in FIG. 3, additional groups of tone-generating circuitry are represented by the switches **312*n* and the corresponding input circuit 300*n*, multiplexer 301*n*, and output circuit 302*n*. The outputs of all of the tone groups are combined with each other in the final summer/amplifier 311 prior to being applied to the system speaker 314**.

The three-state outputs of switches 312 are processed identically to that described hereinabove with respect to FIG. 1. Thus, a set of velocity sensing and envelope generating data is produced as a function of time. Once the key switch is closed, the resultant velocity sensing data is latched until the next activation on that key switch. This envelope and velocity data from each of the key switches and input circuits in each of the groups of switches 312 and **312*n*, in accordance with another aspect of the invention, is multiplexed to simplify output processing. Conventional clock means 320** generates the necessary timing signals including those for clock control, output strobe, envelope rate, and multiplexer rates.

Figure 4:
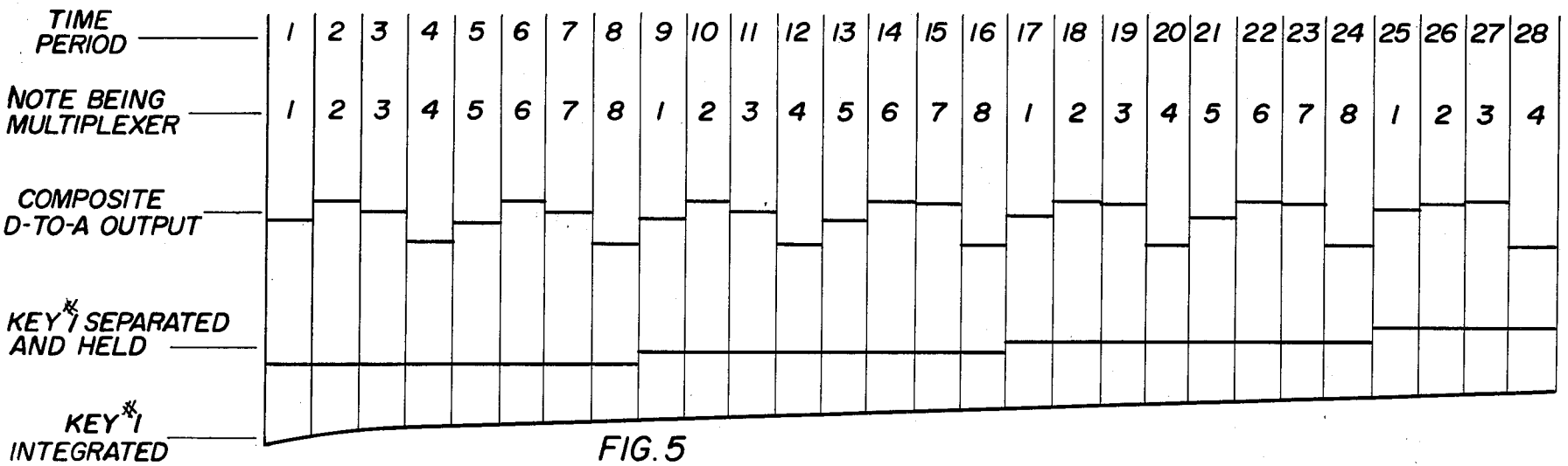
FIG. 4 is a graphical representation of signals generated by the embodiment of the invention illustrated in FIG. 3.

FIG. 4 shows a timing diagram of how the multiplexing system of the particular embodiment of the invention illustrated in FIG. 3 operates when eight notes are being multiplexed. It is understood that any number of notes can be multiplexed and that eight notes were chosen for illustration purposes only. The multiplexing rate (sometimes referred to as "mux rate") is made faster than the rate of change of the envelope signal so that the data may be processed in real time. In FIG. 4, the top two lines illustrate the time periods and notes being multiplexed, respectively. The eight notes are multiplexed in sequence continuously. As hereinabove explained in greater detail, in each time period a set of velocity data and envelope data is obtained for each key. This data is fed through corresponding read-only memories and the result is applied to the multiplying D-to-A converter. This converter produces a reference voltage corresponding to the velocity data and proportional step amplitudes directly related to the envelope data. The composite D-to-A output 304 of FIG. 3 is graphically illustrated by the third line from the top of FIG. 4. In this example, key numbers 4 and 8 are off and remain at a low level all the time. The other keys are actuated or "on" and each is at a particular time in the composite D-to-A output waveform shown in FIG. 2. The fourth line from the top in FIG. 4 graphically illustrates the separation process of the output gate/hold circuit 305 of FIG. 3 for key 1. The bottom line of FIG. 4 shows the smoothed waveform produced by the integrators 305 of FIG. 3 for key 1. The frequency gates 307 combine the frequency information from the frequency spectrum modifier 308 with the integrator outputs. The resultant number of frequency gate outputs are summed together and filtered in a manner which is appropriate for that group of key switches in the summing amplifier and filter circuitry 309. The single combined audio output 310 is combined with similar outputs **310*n* from the other multiplexer channels in the final summer/speaker amplifier 311. The single amplified signal output 313 is applied to the speaker 314** for acoustic reproduction. Thus, by utilizing this multiplexing feature of the invention, considerable circuit economies may be effected because some of the same circuitry may be used for more than one note.

Figure 5:
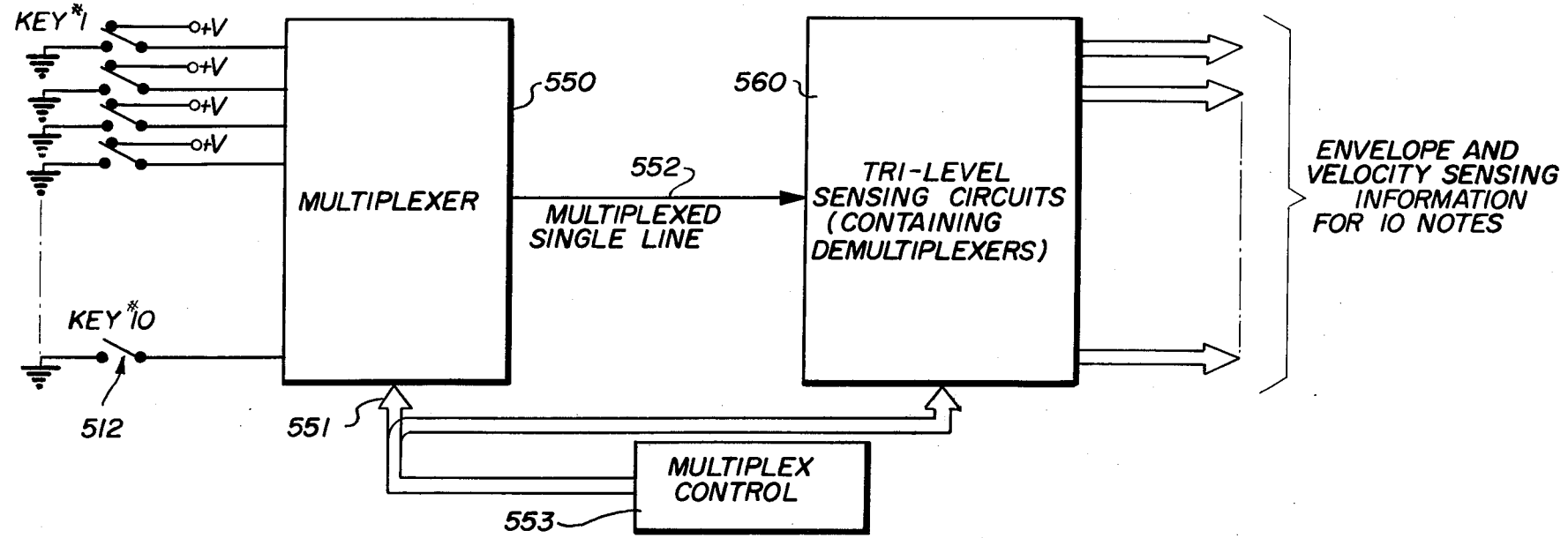
FIG. 5 is a block diagram of an alternative multiple-tone embodiment of the invention in which a multiplexer is employed between the outputs of the keying transducers and the input of the detector circuitry.

As a variation of the multiple-key system, in accordance with another feature of the present invention, the outputs from the keyboard switches 312 and **312*n* of FIG. 3 can be multiplexed, as illustrated in the embodiment of the invention shown in FIG. 5, in order to reduce the number of wires from the keyboard switches to the series of tri-level sensing circuits. A series of key switches 512 are shown which are similar to switches 312 of FIG. 3 and 12 of FIG. 1. A multiplexer 550 is connected to the outputs of switches 512 and continuously cycles through all of the key switch outputs and addresses these outputs, one output at a time, via address lines 551. The multiplexing signals are generated by multiplex control 553. The single output line 552 contains all of the sampled key switch outputs in serial form. The multiplexer can be placed physically near the keyboard so that the single line 552 replaces a bundle of lines required when multiplexing is not used. Although the embodiment of the invention illustrated in FIG. 5 shows only ten switches, it is understood that any number of switches can be employed using the same multiplexer concept. The trilevel sensing circuits 560 are quite similar to those described hereinabove with respect to FIG. 1 and they contain gating or demultiplexing circuits to sample the single line 552 for each key switch serial time period. Circuits 560 are responsive to the same address lines 551 from multiplexer control 553 to sample line 552**. As soon as a change from voltage +V (e.g., +12 volts DC) is detected for a given key switch time period, the transition time counter starts counting. When that key switch time period signal is detected at ground, the particular switch is closed and the transition counter stops counting and the envelope is produced.

The multiplexer 550 can also take the form of an analog multiplexer and would be set up so that the single output 552 would be an analog sample for each key switch output at a given sample time period. The tri-level sensing circuits 560 would then demultiplex the analog sample on line 552 for processing. The demultiplexed signal would be a tri-state signal as previously described in the non-multiplexed system. Thus, once the line 552 is demultiplexed for each tri-level sensing circuit, the processing is exactly as described previously herein.

Thus, there has been shown and described a new and improved tone-generating system for an electronic musical instrument of the percussion type wherein an audible tone closely approximating the corresponding tone of a conventional instrument is generated electronically in response to the manual actuation of the system by the player of the instrument. The invention is suitable for other applications such as a music synthesizer. The use of digital processing techniques removes many of the undesirable system interactions which are inherent in analog circuits and makes it possible to provide a combination of features which heretofore were impractical to implement in conventional electronic musical instruments such as pianos. Such features include an all-digital, touch-responsive keying system which not only utilizes a simplified keying transducer structure but also is not affected by switch contact bounce. For each note or tone of the instrument, time-dependent harmonic structure may be provided as well as variations of the harmonic content with respect to strike amplitude or intensity with which the key is struck to indicate the tone. In addition, the keying, tone generating and envelope control circuitry may be constructed to take advantage of large-scale integration (LSI) techniques. Exact control of various tonal relationships may be achieved and component tolerance problems associated with conventional systems may be eliminated substantially. The multiplexing features of the invention enable the total amount of circuitry and wiring to be substantially reduced.

While a particular embodiment of the invention has been shown and described, it will be obvious to those skilled in the art that changes and modifications may be made without departing from the invention in its broader aspects and therefore, the aim in the appended claims is to cover all such changes and modifications which fall within the true spirit and scope of the invention.

We claim:

1. A tone-generating system for an electronic musical instrument of the percussion type wherein an audible tone is generated electronically in response to the manual actuation of the system by the player of the instrument, with said tone having a predetermined frequency spectrum and an envelope characteristic which varies in accordance with the intensity of the manual actuation by which the player of the instrument actuates the tone, said system comprising: manualy actuable means for initiating generation of said tone; detector means coupled to said tone initiating means and responsive to the actuation of said tone initiating means for developing a control signal indicative of the intensity with which the tone initiating means is manually actuated; means coupled to said detector means and responsive to said control signal for generating a digital scaling signal representative of the variations in amplitude of said initiated tone with respect to the intensity with which said tone initiating means is actuated; oscillator means coupled to said tone initiating means and responsive to the actuation of said tone initiating means for generating an oscillatory signal having said predetermined frequency spectrum; clock means for generating a timing signal; means coupled to said clock means and responsive to said timing signal for generating a digital envelope signal; converter means coupled to said digital scaling signal generating means and to said digital envelope signal generting means to form a composite analog signal; output means coupled to said oscillator means and to said converter means for modulating said oscillatory signal with said composite signal to produce an electrical signal representative of said initiated tone; and an electromechanical transducer coupled to said output means and responsive to said electrical signal for converting said electrical signal into an audible tone.

2. A tone-generating system in accordance with claim 1, in which said tone initiating means includes a two-position switch normally biased to one of said two positions, and in which said detector means includes a tri-level sensing circuit coupled to said switch for developing a keying signal having a first value when said switch is in its normal position, a second value when said switch is in its other position, and a third value when said switch is between said two positions.

3. A tone-generating system in accordance with claim 2, in which said detector means further includes transition time counter means responsive to said keying signal for counting the time that elapses while said switch means is moved from said normal position to said other position and developing a corresponding digital elapsed time signal, and in which said digital scaling signal generating means includes an amplitude scaling memory means having a predetermined plurality of digital amplitude scaling characteristics stored therein and coupled to said transition time counter means and responsive to said elapsed time signal for generating said digital scaling signal.

4. A tone-generating system in accordance with claim 1, in which said digital envelope signal generating means includes tonal envelope memory means having a predetermined digitized representation of a tonal wave envelope stored therein and capable of being read out incrementally, and further includes envelope control counter means coupled between said clock means and said tonal envelope memory means and responsive to said timing signal for controlling the rate at which said digitized representation is read out of said tonal envelope memory means to generate said digital envelope signal.

5. A tone-generating system in accordance with claim 4, in which said digital envelope signal includes a clock rate control signal and in which said clock means comprises a variable rate clock responsive to said clock rate control signal, whereby said digital envelope signal is generated at different rates for the initial portion of the tone than for succeeding portions of the tone.

6. A tone-generating system in accordance with claim 1, which further includes a damper control circuit coupled between said detector means and said digital envelope signal generating means, and actuating means for selectively actuating said damper control circuit, whereby said digital envelope signal generating means may be selectively controlled to vary the duration of the initiated tone to simulate selectively a damped or undamped tone of a conventional instrument.

7. A tone-generating system in accordance with claim 1, which further comprises frequency spectrum modifying means coupled between said oscillator means and said output means and responsive to said digital scaling signal for varying the harmonic content of said oscillatory signal in accordance with the intensity with which said tone is initiated.

8. A tone-generating system for an electronic keyboard musical instrument wherein an audible tone closely approximating the corresonding tone of a conventional keyboard instrument is generated electronically in response to the depression and subsequent release of a key by the player of the instrument, with said tone having a predetermined frequency spectrum and an envelope characteristic which varies in accordance with the intensity with which the key is depressed, said system comprising: keying transducer means including a two-position electrical switch and a manually actuable key coupled to said switch for placing said switch in one position upon depression of said key and in the other position upon release of said key, said key being normally in released position and said switch developing a keying signal having a first value when said key is released, a second value when said key is depressed, and a third value when said key is between the released and depressed positions; tri-level sensing means coupled to said switch and responsive to said keying signal for sensing which state said switch is in and developing a corresponding counter control sighal; transition time counter means coupled to said sensing means and responsive to said counter control signal for counting the time that elapses when said key is moved from the released position to the depressed position and developing a corresponding transition time signal; amplitude scaling read-only memory means having a predetermined plurality of digital amplitude scaling characteristics stored therein, coupled to said transition time counter means and responsive to said transition time signal for developing a digital amplitude scaling signal corresponding to the intensity with which said key is depressed; variable rate clock means for generating a timing signal having a rate which is capable of being varied in response to an external control signal; envelope control counter means coupled to said variable rate clock means and responsive to said timing signal for generating an envelope control signal; tonal envelope memory means having a predetermined digitized representation of a tonal wave envelope stored therein and capable of being read out incrementally, coupled to said envelope control counter means and responsive to said envelope control signal for generating a digital envelope signal; oscillator means coupled to said keying transducer means and responsive to the actuation of said key to said depressed position for generating an oscillatory electrical signal having said predetermined frequency spectrum; converter means coupled to said amplitude scaling read-only memory means and to said tonal envelope memory means to form a composite analog signal; output gating means coupled to said oscillator means and to said converter means for modulating said oscillatory signal with said composite analog signal to produce an electrical signal representative of said initiated tone; and an electrochemical transducer coupled to said output means and responsive to said electrical signal for converting said composite electrical signal into an audible tone.

9. A tone-generating system in accordance with claim 8, which further includes a damper control circuit coupled to said tri-level sensing means and said variable rate clock means, and means for selectively actuating said damper control circuit, whereby the duration of the initiated tone may be shortened to simulate a damped tone of conventional piano.

10. A tone-generating system in accordance with claim 8, in which said converter means includes integrating means for shaping the waveform of said composite analog signal.

11. A tone-generating system in accordance with claim 8, which further comprises frequency spectrum modifying means coupled between said oscillator means and said output gating means and responsive to said digital amplitude scaling signal for varying the harmonic content of said oscillatory signal in accordance with the intensity with which said tone is initiated.

12. A tone-generating system for an electronic musical instrument of the percussion type wherein a plurality of audible tones are generated electronically in response to the manual actuation of the system by the player of the instrument, with each said tone having a predetermined frequency spectrum and an envelope characteristic which varies in accordance with the intensity of the manual actuation by which the player of the instrument actuates the tone, and with various ones of said tones being assigned to predetermined tonal groups, said system comprising: a plurality of manually actuable means for initiating generation of said tones; a corresponding plurality of detector means coupled to said tone initiating means and responsive to the actuation of said tone initiating means for developing control signals indicative of the intensity with which the tone initiating means is manually actuated for each said tone initiated; means coupled to said detector means and responsive to said control signals for generating a digital scaling signal representative of the variations in amplitude of said initiated tones with respect to the intensity with which said tone initiating means is actuated for each said tone initiated; oscillator means coupled to said tone initiating means and responsive to the actuation of said tone initiating means for generating an oscillatory signal having said predetermined frequency spectrum for each said tone initiated; clock means for generating timing signals; a plurality of multiplexing means respectively associated with said tonal groups and each coupled to the digital scaling signal generating means for its associated tonal group and responsive to said timing signals for generating multiplexed digital scaling signal for each said tonal group; means coupled to said clock means and responsive to said timing signals for generating a digital envelope signal for each said tone initiated; a plurality of converter means respectively coupled to said plurality of multiplexing means and to said digital envelope signal generating means to form a composite analog signal for each said tonal group; a plurality of output means each coupled to said oscillator means and to said converter means for separating and smoothing the envelope signals in the tonal groups and for modulating said oscillatory signal with said separated signls to produce electrical signals representative of said initiated tones; and means, including a summing amplifier and an electromechanical transducer, coupled to said output means for combining said electrical signals and converting said combined electrical signals into audible tones.

13. A tone-generating system in accordance with claim 12, in which said tone initiating means includes a plurality of two-position switches normally biased to one of said two positions, and in which said detector means includes an associated plurality of tri-level sensing circuits respectively coupled to said switches for developing corresponding keying signals each having a first value when the associated switch is in its normal position, a second value when said associated switch is in its other position, and a third value when said associated switch is between said two positions.

14. A tone-generating system in accordance with claim 13, in which said detector means further includes a corresponding plurality of transition time counter means respectively responsive to said keying signals for individually counting the time that elapses while each said switch is moved from said normal position to said other position and developing corresponding digital elapsed time signals, and in which said digital scaling signal generating means includes a plurality of amplitude scaling memory means each having a predetermined plurality of digital amplitude scaling characteristics stored therein and respectively coupled to said transition time counter means and respectively responsive to said elapsed time signals for generating said digital scaling signals.

15. A tone-generating system in accordance with claim 12, in which said digital envelope signal generating means includes a plurality of tonal envelope memory means each having a predetermined digitized representation of a tonal wave envelope stored therein and capable of being read out incrementally, and further includes a plurality of envelope control counter means respectively coupled between said clock means and said tonal envelope memory means and responsive to said timing signals for respectively controlling the rate at which each said digitized representation is read out of its associated tonal envelope memory means to generate said digital envelope signals.

16. A tone-generating system in accordance with claim 15, in which each said digital envelope signal includes a clock rate control signal and in which said clock means comprises a variable rate clock responsive to said clock rate control signal, whereby each said digital envelope signal is generated at different rates for the initial portion of the tone than for succeeding portions of the tone.

17. A tone-generating system in accordance with claim 12, which further includes a damper control circuit coupled between said detector means and said digital envelope signal generating means, and actuating means for selectively actuating said damper control circuit, whereby said digital envelope signal generating means may be selectively controlled to vary the duration of each initiated tone to simulate a damped or undamped tone of a conventional instrument.

18. A tone-generating system in accordance with claim 12, which further comprises a plurality of frequency spectrum modifying means respectively coupled between said oscillator means and said output means and respectively responsive to said digital scaling signals for varying the harmonic content of each said oscillatory signal in accordance with the intensity with which the associated tone is initiated.

19. A tone-generating system for an electronic keyboard musical instrument wherein a pluralty of audible tones closely approximating the corresponding tones of a conventional keyboard instrument are each generated electronically in response to the depression and subsequent release of a corresponding key by the player of the instrument, with each said tone having a predetermined frequency spectrum and an envelope characteristic which varies in accordance with the intensity with which the corresponding key is depressed, and with various ones of said tones being assigned to predetermined tonal groups, said system comprising; keying transducer means including a plurality of two-position electrical switches and a corresponding plurality of manually actuable keys respectively coupled to said switches for individually placing said switches in one position upon depression of the corresponding key and in the other position upon release of the corresponding key, each said key being normally in its released position and each said switch developing a keying signal having a first value when said key is released, a second value when said key is depressed, and a third value when said key is between the released and depressed positions; an associated plurality of tri-level sensing means respectively coupled to said switches and respectively responsive to said keying signals for sensing which state each said switch is in and developing a corresponding plurality of counter control signals; a corresponding plurality of transition time counter means respectively coupled to said tri-level sensing means and respectively responsive to said counter control signals for individually counting the time that elapses when each said key is moved from the released position to the depressed position and developing corresponding transition time signals; means for generating multiplexer timing signals; a plurality of multiplexing means respectively associated with said tonal groups and each coupled to said transition time counter means for its associated tonal group and responsive to said multiplexer timing signals for generating a multiplexed transition time signal; a plurality of amplitude scaling read-only memory means each corresponding to a different one of said tonal groups and each having a predetermined plurality of digital amplitude scaling characteristics stored therein, said memory means coupled to said multiplexing means and responsive to said multiplexed transition time signals for developing a plurality of multiplexed digital amplitude scaling signals each corresponding to the intensity with which its associated key is depressed; variable rate clock means for generating a plurality of envelope control counter timing signals each having a rate which is capable of being varied in response to an external control signal; a plurality of envelope control counter means corresponding to said tonal groups and each coupled to said variable rate clock means and respectively responsive to said envelope control counter timing signals for generating an envelope control signal for its associated tone; a plurality of tonal envelope memory means corresponding to said tonal groups and each having a predetermined digitized representation of a tonal wave envelope stored therein and capable of being read out incrementally and each respectively coupled to said envelope control counter means and respectively responsive to said envelope control signals for generating a corresponding digital envelope signal for each said tone initiated; oscillator means coupled to said keying transducer means and responsive to the actuation of said keys to said depressed position for generating an oscillatory electrical signal having said predetermined frequency spectrum for each said tone initiated; a plurality of converter means corresponding to said tonal groups and respectively coupled to said amplitude scaling memory means and to said tonal envelope memory means to form a composite analog signal for each tonal group; a plurality of output gating means for seperating the tone envelopes in the tonal groups and means coupled to said oscillator means and to said converter means for modulating said oscillatory signals with said separated analog signals to produce electrical signals representative of said initiated tones; and means, including a summing amplifier and an electromechanical transducer, coupled to said output means for combining said electrical signals and converting said combined electrical signals into audible tones.

20. A tone-generating system in accordance with claim 19, which further includes a plurality of damper control circuits respectively coupled to said tri-level sensing means and said variable rate clock means, and means for selectively actuating each said damper control circuit, whereby the duration of each initiated tone may be selectively shortened to simulate a damped tone of a conventional piano.

21. A tone-generating system in accordance with claim 19, in which each said converter means includes integrating means for shaping the waveform of said composite analog signal.

22. A tone-generating system in accordance with claim 19, which further comprises a plurality of frequency spectrum modifying means respectively coupled between said oscillator means and said output gating means and respectively responsive to said digital amplitude scaling signals for varying the harmonic content of said oscillatory signals in accordance with the intensity with which its respective tone is initiated.

23. A tone-generating system for an electronic musical instrument of the percussion type wherein a plurality of audible tones are generated electronically in response to the manual actuation of the system by the player of the instrument, with each said tone having a predetermind frequency spectrum and an envelope characteristic which varies in accordance with the intensity of the manual actuation by which the player of the instrument actuates the tone, said system comprising: a plurality of manually actuable means for initiating generation of said tones; timing means for generating multiplexing signals; multiplexing means, including an output terminal, coupled to said plurality of tone initiating means and responsive to said multiplexing signals for addressing each said tone initiating means individually and providing a corresponding serial output signal at said output terminal; detector means including a demultiplexer, coupled to said output terminal and responsive to said serial output signal for developing a control signal indicative of the intensity with which each said tone initiating means is manually actuated; means coupled to said detector means and responsive to said control signal for generating a digital scaling signal representative of the variations in amplitude of said initiated tones with respect to the intensity with which said tone initiating means is actuated for each said tone initiated; oscillator means coupled to said tone initiating means and responsive to the actuation of said tone initiating means for generating an oscillatory signal having said predetermined frequency spectrum for each said tone initiated; clock means for generating timing signals; means coupled to said clock means and responsive to said timing signals for generating a digital envelope signal for each said tone initiated; converter means coupled to said digital scaling signal generating means and to said digital envelope signal generating means to form a composite analog signal; output means for separating said composite analog signal into individual tone analog signals and means coupled to said oscillator means for modulating said oscillatory signals with said tone analog signals to produce electrical signals representative of said initiated tones; and an electromechanical transducer coupled to said output means and responsive to said electrical signals for converting said electrical signals into audible tones.

24. A tone-generating system in accordance with claim 23, in which each said tone initiating means includes a two-position switch normally biased to one of said two positions, and in which said detector means further includes a tri-level sensing circuit coupled to an output terminal for developing a separate keying signal for each switch, each said keying signal having a first value when its associated swtich is in its normal position, a second value when its associated switch is in its other position, and a third value when its associated switch is between said two positions.

25. A tone-generating system in accordance with claim 24, in which said detector means further includes a plurality of transition time counter means respectively responsive to said keying signals for counting the time that elapses while each said switch is moved from said normal position to said other position and developing corresponding digital elapsed time signals, and in which said digital scaling signal generating means includes a plurality of amplitude scaling memory means each having a predetermined plurality of digital amplitude scaling characteristics stored therein and respectively coupled to said transition time counter means and respectively responsive to said elapsed time signals for generating said digital scaling signals.

26. A tone-generating system in accordance with claim 23, in which said digital envelope signal generating means includes a plurality of tonal envelope memory means each having a predetermined digitized representation of a tonal wave envelope stored therein and capable of being read out incrementally, and further includes a plurality of envelope control counter means respectively coupled between said clock means and said tonal envelope memory means and responsive to said timing signals for respectively controlling the rate at which each said digitized representation is read out of its associated tonal envelope memory means to generate said digital envelope signals.

27. A tone-generating system in accordance with claim 26, in which each said digital envelope signal includes a clock rate control signal and in which said clock means comprises a variable rate clock responsive to said clock rate control signal, whereby each said digital envelope signal is generated at different rates for the initial portion of the tone than for succeeding portions of the tone.

28. A tone-generating system in accordance with claim 23, which further includes a damper control circuit coupled between said detector means and said digital envelope signal generating means, and actuating means for selectively actuating said damper control circuit, whereby said digital envelope signal generating means may be selectively controlled to vary the duration of each initiated tone to simulate a damped or undamped tone of a conventional instrument.

29. A tone-generating system in accordance with claim 23, which further comprises a plurality of frequency spectrum modifying means respectively coupled between said oscillator means and said output means and respectively responsive to said digital scaling signal for varying the harmonic content of each said oscillatory signal in accordance with the intensity with which the associated tone is initiated.

30. A tone-generating system for an electronic keyboard musical instrument wherein a plurality of audible tones closely approximating the corresponding tone of a conventional keyboard instrument are each generated electronically in response to the depression and subsequent release of a corresponding key by the player of the instrument, with each said tone having a predetermined frequency spectrum and an envelope characteristic which varies in accordance with the intensity with which the corresponding key is depressed, said system comprising: keying transducer means including a plurality of two-position electrical switches and a corresponding plurality of manually actuable keys respectively coupled to said switches for individually placing said switches in one position upon depression of the corresonding key and in the other position upon release of the corresponding key, each said key being normally spring-biased to its released position and each said switch developing a keying signal having a first value when said key is released, a second value when said key is depressed, and a third value when said key is between the released and depressed positions; timing means for generating multiplex signals; multiplexing means, including an output terminal, coupled to said keying transducer means and responsive to said multiplexing signals for addressing each said switch individually and providing a corresponding serial keying signal at said output terminal; tri-level sensing means including a demultiplexer, coupled to said two position electrical switches and responsive to said serial keying signal for sensing which state each said switch is in and deveoping a corresponding counter control signal for each said tone initiated; a plurality of transition time counter means coupled to said sensing means and respectively resonsive to said counter control signal for individually counting the time that elapses when each said key is moved from the released position to the depressed position and developing corresponding transition time signals; a plurality of amplitude scaling read-only memory means each having a predetermined plurality of digital amplitude scaling characteristics stored therein, coupled to said transition time counter means and respectively responsive to said transition time signals for developing a digital amplitude scaling signal corresponding to the intensity with which said key is depressed for each said tone initiated; variable rate clock means for generating a plurality of envelope control couner timing signals each having a rate which is capable of being varied in response to an external control signal; a plurality of envelope control counter means coupled to said variable rate clock means and respectively responsive to said timing signals for generating an envelope control signal for each said tone initiated; a plurality of tonal envelope memory means each having a predetermined digitized representation of a tonal wave envelope stored therein and capable of being read out incrementally and each respectively coupled to said envelope control counter means and respectively responsive to said envelope control signals for generating a corresponding digital envelope signal for each said tone initiated; oscillator means coupled to said keying transducer means and responsive to the actuation of said keys to said depressed position for oscillatory electrical signal having said predetermined frequency spectrum for each said tone initiated; a plurality of converter means respectively coupled to said amplitude scaling read-only memory means and to said tonal envelope memory means to form a composite converter output signal; a plurality of output gating means coupled to said converter output signal for separating said signal into individual tone analog signals and coupling into said oscillator means for modulating said oscillatory signals to produce electrical signals representative of said initiated tones; and an electromechanical transducer coupled to said output means and responsive to said electrical signals for converting said composite electrical signals into audible tones.

31. A tone-generating system in accordance with claim 30, which further includes a plurality of damper control circuits respectively coupled to said tri-level sensing means and said variable rate clock means, and means for selectively actuating each said damper control circuit, whereby the duration of each initiated tone may be selectively shortened to simulate a damped tone of a conventional piano.

32. A tone-generating system in accordance with claim 30, in which each said converter means includes integrating means for shaping the waveform of said composite analog signals.

33. A tone-generating system in accordance with claim 30, which further comprises a plurality of frequency spectrum modifying means respectively coupled between said oscillator means and said output gating means and respectively responsive to said digital amplitude scaling signal for varying the harmonic content of said oscillatory signal in accordance with the intensity with which its respective tone is initiated.

* * * * *

UNITED STATES PATENT AND TRADEMARK OFFICE

CERTIFICATE OF CORRECTION

PATENT NO. : 4,067,253

DATED : January 10, 1978

INVENTOR(S) : Robert W. Wheelwright and Peter E. Solender

It is certified that error appears in the above-identified patent and that said Letters Patent are hereby corrected as shown below:

Column 5, line 13, after "may" delete --be--;

Column 5, line 28, before "control" insert --counter--;

Column 5, line 48, "transmit" should be --transit--;

Column 6, line 30, after "memory" insert --30--;

Column 13, line 41, "electrochemical" should be --electromechanical--;

Column 14, line 27, "signal" should be --signals--;

Column 19, line 29, "couner" should be --counter--;

Column 20, line 5, after "for" insert --generating an--

Signed and Sealed this

*Sixth* Day of *June 1978*

[SEAL]

*Attest:*

RUTH C. MASON
*Attesting Officer*

DONALD W. BANNER
*Commissioner of Patents and Trademarks*